US009117430B2

(12) United States Patent
Suenaga et al.

(10) Patent No.: US 9,117,430 B2
(45) Date of Patent: Aug. 25, 2015

(54) ELECTRIC STRINGED MUSICAL INSTRUMENT AND METHOD OF DESIGNING THE SAME

(71) Applicant: Yamaha Corporation, Hamamatsu-Shi, Shizuoka-Ken (JP)

(72) Inventors: Yuichiro Suenaga, Hamamatsu (JP); Shinya Tamura, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 14/154,884

(22) Filed: Jan. 14, 2014

(65) Prior Publication Data

US 2014/0196595 A1 Jul. 17, 2014

(30) Foreign Application Priority Data

Jan. 15, 2013 (JP) ..... 2013-004838

(51) Int. Cl.

| | |
|---|---|
| ***G10H 3/12*** | (2006.01) |
| ***G10H 1/32*** | (2006.01) |
| ***G10H 3/18*** | (2006.01) |
| *G10D 1/08* | (2006.01) |
| *G10D 3/04* | (2006.01) |

(52) U.S. Cl.

CPC . *G10H 3/18* (2013.01); *G10H 1/32* (2013.01); *G10H 3/12* (2013.01); *G10H 3/185* (2013.01); *G10D 1/085* (2013.01); *G10D 3/04* (2013.01); *Y10T 29/42* (2015.01)

(58) Field of Classification Search

USPC ..... 84/291, 294, 296
IPC ..... G10H 1/32,3/12, 3/18, 2220/465
See application file for complete search history.

(56) References Cited

U.S. PATENT DOCUMENTS

| | | | | | |
|---|---|---|---|---|---|
| 3,595,981 | A | * | 7/1971 | Hopping | 84/726 |
| 3,633,452 | A | * | 1/1972 | Beasley | 84/263 |
| 4,218,951 | A | | 8/1980 | Tressel | |
| 4,236,433 | A | * | 12/1980 | Holland | 84/726 |
| 4,567,805 | A | | 2/1986 | Clevinger | |
| 4,635,523 | A | | 1/1987 | Merchant | |
| 4,704,935 | A | * | 11/1987 | Franklin | 84/312 P |

(Continued)

FOREIGN PATENT DOCUMENTS

| | | | |
|---|---|---|---|
| DE | 10 2010 004533 | A1 | 7/2011 |
| GB | 422735 | A | 1/1935 |

(Continued)

OTHER PUBLICATIONS

Extended European Search Report issued for EP 14151264.0, mailing date Apr. 3, 2013.

(Continued)

*Primary Examiner* — David Warren
(74) *Attorney, Agent, or Firm* — Dickstein Shapiro LLP

(57) ABSTRACT

An electric stringed musical instrument including: a string which vibrates by a performance operation; a body which supports the string via a bridge; a pickup sensor mounted on a portion which vibrates by a vibration of the string, the pickup sensor being configured to detect a vibration having propagated from the string and output an electric signal; and a supporter having a spring structure which supports the bridge with respect to the body to bring a vibration characteristic of the electric stringed musical instrument closer to a vibration characteristic of one acoustic stringed musical instrument.

12 Claims, 10 Drawing Sheets

(56) References Cited

U.S. PATENT DOCUMENTS

| | | | | |
|---|---|---|---|---|
| 4,738,178 | A * | 4/1988 | Deering | 84/726 |
| 4,823,668 | A * | 4/1989 | Marrs | 84/296 |
| 4,989,491 | A * | 2/1991 | Baggs | 84/723 |
| 5,027,691 | A * | 7/1991 | Kennedy | 84/727 |
| 5,123,326 | A | 6/1992 | Clevinger | |
| 6,008,440 | A | 12/1999 | Yamada | |
| 6,573,439 | B2 * | 6/2003 | Wilson | 84/291 |
| 7,115,803 | B2 * | 10/2006 | Machida | 84/294 |
| 7,115,809 | B2 * | 10/2006 | Kavanaugh | 84/726 |
| 7,145,063 | B2 * | 12/2006 | Redard | 84/267 |
| 7,151,210 | B2 * | 12/2006 | Janes et al. | 84/291 |
| 7,339,106 | B2 | 3/2008 | Tamura | |
| 7,507,885 | B2 * | 3/2009 | Coke | 84/291 |
| 7,514,614 | B2 * | 4/2009 | McGrew | 84/291 |
| 8,217,254 | B2 * | 7/2012 | Zoran et al. | 84/743 |
| 8,278,538 | B1 * | 10/2012 | D'Anda et al. | 84/294 |
| 2004/0060417 | A1 * | 4/2004 | Janes et al. | 84/291 |
| 2005/0028669 | A1 * | 2/2005 | Kavanaugh | 84/726 |
| 2005/0051019 | A1 * | 3/2005 | Machida | 84/294 |
| 2005/0109197 | A1 * | 5/2005 | Garrett et al. | 84/726 |
| 2006/0042454 | A1 * | 3/2006 | Tamura | 84/730 |
| 2006/0054009 | A1 * | 3/2006 | Redard | 84/723 |
| 2006/0117938 | A1 | 6/2006 | Gillette | |
| 2007/0028752 | A1 * | 2/2007 | McGrew | 84/726 |
| 2007/0295195 | A1 | 12/2007 | Tamura | |
| 2008/0127800 | A1 * | 6/2008 | Koentopp | 84/267 |
| 2008/0202310 | A1 * | 8/2008 | Coke | 84/291 |
| 2010/0101396 | A1 * | 4/2010 | Ayers | 84/294 |
| 2010/0307313 | A1 * | 12/2010 | Zoran et al. | 84/192 |
| 2011/0126690 | A1 * | 6/2011 | Hendricks | 84/307 |
| 2011/0226118 | A1 | 9/2011 | Kuroki | |
| 2011/0232458 | A1 * | 9/2011 | Altheim | 84/293 |
| 2011/0277614 | A1 * | 11/2011 | Aspri | 84/294 |
| 2014/0102281 | A1 * | 4/2014 | Hendricks | 84/313 |
| 2014/0196594 | A1 * | 7/2014 | Suenaga et al. | 84/731 |
| 2014/0196595 | A1 * | 7/2014 | Suenaga et al. | 84/731 |

FOREIGN PATENT DOCUMENTS

| | | | |
|---|---|---|---|
| JP | S49-131110 | A | 12/1974 |
| JP | S55-83097 | A | 6/1980 |
| JP | S58-35596 | A | 3/1983 |
| JP | S60-154299 | A | 8/1985 |
| JP | H09-127952 | A | 5/1997 |
| JP | 3225856 | B2 | 11/2001 |
| JP | 3553059 | B1 | 8/2004 |
| JP | 2007-333789 | A | 12/2007 |
| JP | 4259429 | B2 | 4/2009 |
| JP | 2011-197325 | A | 10/2011 |
| JP | S55-38323 | A | 7/2014 |

OTHER PUBLICATIONS

Rossing et al.; "Accoustical Response of Guitars", SMAC 83, Jan. 1, 1985, pp. 311-332.

* cited by examiner

ELECTRIC STRINGED MUSICAL INSTRUMENT AND METHOD OF DESIGNING THE SAME

CROSS REFERENCE TO RELATED APPLICATION

The present application claims priority from Japanese Patent Application No. 2013-004838, which was filed on Jan. 15, 2013, the disclosure of which is herein incorporated by reference in its entirety.

BACKGROUND OF THE INVENTION

1. Field of the Invention

The present invention relates to an electric stringed musical instrument configured to detect vibrations transmitted from a string supported by a body via a bridge and produce an output, and to a method of designing the electric stringed musical instrument.

2. Description of the Related Art

There is conventionally known an electric stringed musical instrument configured to pick up vibrations of strings by means of a pickup sensor to produce a sound of a stringed instrument. For example, Patent Document 1 (Japanese Patent No. 3225856) discloses an electric violin as an electric stringed musical instrument. This violin includes a body for supporting strings via a bridge, and this body is composed of a plurality of layers stacked on one another. Sticky layers are sandwiched between the plurality of layers to reduce a large amount of energy generated by vibrations of the strings and radiated to air as a sound via vibrations of the body, resulting in a smaller or no volume of a sound emitted to air.

Patent Document 2 (Japanese Patent Application Publication No. 60-154299) discloses an electric stringed musical instrument including a member constituted by a stiff base supporter, a bridge suspension, a span, and a bridge crown which are formed integrally with each other. This member is placed on a solid body via a height adjusting mechanism. The bridge crown supports strings, and a pickup constituted by a piezoelectric element is provided between the stiff base supporter and the span. In this electric stringed musical instrument, the bridge suspension has flexibility. Furthermore, this electric stringed musical instrument uses the flexible bridge suspension to transmit energy between vibrations of the strings and the pickup, whereby an instrument sound based on an electric signal obtained by conversion of the pickup is brought closer to a sound of an acoustic stringed musical instrument.

SUMMARY OF THE INVENTION

The electric stringed musical instrument disclosed in Patent Document 1 can sufficiently reduce the volume of the sound as described above, but the body is formed of a material having high stiffness. Thus, vibration energy of the strings remains in the strings for a relatively long time, and the vibrations of the strings decay slowly, leading to discomfort to a player of the common acoustic stringed musical instrument. In addition, while a common acoustic stringed musical instrument causes a main resonance of the body when seen from the bridge to a body-side, this resonance does not occur due to the structure of the body in the case of the electric stringed musical instrument, or if occurs the magnitude of the resonance is very small, and a resonant frequency deviates from that of the common, acoustic stringed musical instrument. Accordingly, differences of sound volume, a tone quality, and decay characteristics with respect to a pitch in this conventional electric stringed musical instrument greatly differ from those in the common acoustic stringed musical instrument, so that a playability and an expressive power of the common acoustic stringed musical instrument cannot be obtained.

Furthermore, in the electric stringed musical instrument disclosed in Patent Document 2, the instrument sound based on the electric signal obtained by conversion of the pickup is brought closer to the sound of the acoustic stringed musical instrument as described above, but more concrete efforts are not found to bring the instrument sound closer to the sound of the actual, acoustic stringed musical instrument in vibration characteristics such as a resonant frequency and a resonance level.

This invention has been developed in view of the above-described situations, and it is an object of the present invention to provide: an electric stringed musical instrument having no resonance body which is capable of improving a playability and an expressive power of musical performance by bringing an instrument sound of the electric stringed musical instrument closer to that of a common acoustic stringed musical instrument in characteristics of a stringed instrument sound such a sound volume, a tone quality, and decay characteristics with respect to a pitch; and a method of designing the electric stringed musical instrument.

The object indicated above may be achieved according to the present invention which provides an electric stringed musical instrument including: a string which vibrates by a performance operation; a body which supports the string via a bridge; a pickup sensor mounted on a portion which vibrates by a vibration of the string, the pickup sensor being configured to detect a vibration having propagated from the string and output an electric signal; and a supporter having a spring structure which supports the bridge with respect to the body to bring a vibration characteristic of the electric stringed musical instrument closer to a vibration characteristic of one acoustic stringed musical instrument.

The object indicated above may also be achieved according to the present invention which provides a method of designing an electric stringed musical instrument comprising a string which vibrates by a performance operation; a body which supports the string via a bridge; a pickup sensor mounted on a portion which vibrates by a vibration of the string, the pickup sensor being configured to detect a vibration having propagated from the string and output an electric signal; and a supporter having a spring structure which supports the bridge with respect to the body, the method including designing a mass of components around the bridge of the electric stringed musical instrument, losses due to the bridge and the supporter, and a spring constant of the supporter such that a frequency of one peak in the vibration characteristic of the electric stringed musical instrument is brought closer to one of frequencies of two peaks in a vibration characteristic of one acoustic stringed musical instrument, when compared with a case where the supporter is not used.

In a common acoustic stringed musical instrument, vibration characteristics near a bridge have two peaks and one dip due to vibration characteristics (i.e., resonance characteristics) having a peak caused by a top board and vibration characteristics (i.e., anti-resonance characteristics) having a dip caused by air near a sound hole and in a body. In the present invention configured as described above, the bridge is supported by the supporter, and the supporter is set so as to achieve vibration characteristics having a peak at a position of a peak of vibration characteristics of an acoustic stringed musical instrument. Thus, the vibration characteristics in the present invention have one of the two peaks of the vibration characteristics of the acoustic stringed musical instrument and thereby are generally equal to those of the acoustic stringed musical instrument. As a result, also in the electric stringed musical instrument including a body having high stiffness and not including the resonance body, vibration characteristics near the bridge can be brought closer to those of a common acoustic stringed musical, instrument to improve a playability and an expressive power of musical performance.

FORMS OF THE INVENTION

The reference numerals in the brackets attached to respective constituent elements of the device in the following description correspond to reference numerals used in the following embodiments to identify the respective constituent elements. The reference numerals attached to each constituent element indicates a correspondence between each element and its one example, and each element is not limited to the one example.

To achieve the objected described above, the present invention provides an electric stringed musical instrument comprising: a string (14) which vibrates by a performance operation; a body (11) which supports the string via a bridge (12); a pickup sensor (16) mounted on a portion near the bridge, which portion vibrates by a vibration of the string, the pickup sensor being configured to detect a vibration having propagated from the string and output an electric signal; and a supporter (13; 41, 42; 43; 44; 45) having a spring structure which supports the bridge with respect to the body to achieve a vibration characteristic of one acoustic stringed musical instrument.

In this configuration, the supporter (13) is a plate spring whose one end or opposite ends are fixed to the body, for example. Also, the supporter (43) may be an elastic member interposed between the body and the bridge. Also, the supporter (44, 45) may be a thin plate that is formed integrally with the body in a state in which a space is formed between the supporter and the body. Also, the supporter (41, 42) may be a plate having high stiffness and a coil spring, provided on an upper face of the body, for supporting the plate. Also, a spring constant of the supporter may be different from that of a top board of the one acoustic stringed musical instrument. Specifically, the spring constant of the supporter may be greater than that of the top board of the one acoustic stringed musical instrument.

Another feature of the present invention is that a vibration characteristic due to the supporter achieves a frequency of a higher one of two peaks of a vibration characteristic of a top board and a vibration characteristic due to air near a sound hole and in a body in the one acoustic stringed musical instrument. In this configuration, the vibration characteristic due to the supporter is a vibration characteristic having a peak within a range between 90 Hz and 270 Hz, for example.

While the vibration characteristic of the common acoustic stringed musical instrument is a vibration characteristic having two peaks and one dip as described above, a higher one of the two peaks in frequency mainly relates to the vibration characteristic of the top board and notably exhibits the vibration characteristic near a bridge of the common acoustic stringed musical instrument. Accordingly, in another feature of the present invention, the vibration characteristic due to the supporter is adjusted to have a higher one of the two peaks in frequency (e.g., a peak corresponding to a frequency within the range between 90 Hz and 270 Hz). As a result, the vibration characteristic near the bridge can be brought closer to that of the common acoustic stringed musical instrument, leading to more satisfactory improvement in a playability and an expressive power of musical performance.

To achieve the objected described above, the present invention also provides a method of designing an electric stringed musical instrument comprising a string (14) which vibrates by a performance operation; a body (11) which supports the string via a bridge (12); a pickup sensor (16) mounted on a portion which vibrates by a vibration of the string, the pickup sensor being configured to detect a vibration having propagated from the string and output an electric signal; and a supporter (13; 41, 42; 43; 44; 45) having a spring structure which supports the bridge with respect to the body, the method comprising designing a mass of components around the bridge of the electric stringed musical instrument, losses due to the bridge and the supporter, and a spring constant of the supporter such that a frequency of one peak in the vibration characteristic of the electric stringed musical instrument is brought closer to one of frequencies of two peaks in a vibration characteristic of one acoustic stringed musical instrument, when compared with a case where the supporter is not used.

The method may further comprise: obtaining the frequencies of the two peaks in the vibration characteristic of the one acoustic stringed musical instrument obtaining the frequency of the one peak in the vibration characteristic of the electric stringed musical instrument; and designing the mass of the components around the bridge of the electric stringed musical instrument, the losses due to the bridge and the supporter, and the spring constant of the supporter by referring to the obtained frequency of the one peak and the obtained frequencies of the two peaks.

In the method, the spring constant of the supporter may be greater than that of a portion of a top board of the one acoustic stringed musical instrument, which portion is located around a bridge of the one acoustic stringed musical instrument.

The method may further comprise: obtaining the frequencies of the two peaks in the vibration characteristic of the one acoustic stringed musical instrument, using a first equivalent electric circuit converted from a mass model comprising a top board of the one acoustic stringed musical instrument and elements relating to air; obtaining the frequency of the one peak in the vibration characteristic of the electric stringed musical instrument, using a second equivalent electric circuit produced by excluding the elements relating to air from the first equivalent electric circuit; and designing the mass of the components around the bridge of the electric stringed musical instrument, the losses due to the bridge and the supporter, and the spring constant of the supporter such that the frequency of the one peak in the vibration characteristic of the electric stringed musical instrument is brought closer to a frequency of a higher one of the two peaks in the vibration characteristic of the one acoustic stringed musical instrument, when compared with the case where the supporter is not used.

BRIEF DESCRIPTION OF ME DRAWINGS

The objects, features, advantages, and technical and industrial significance of the present invention will be better understood by reading the following detailed description of the embodiment of the invention, when considered in connection with the accompanying drawings, in which.

Figure 2A:
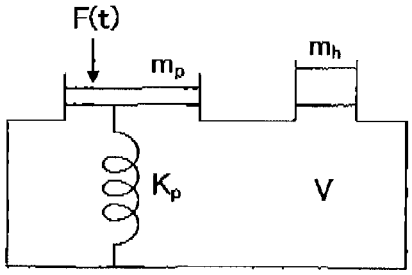
FIG. 2A is a view illustrating a two-mass model representing motion of a common acoustic guitar including a solid back board and a solid side face.
Figure 2B:
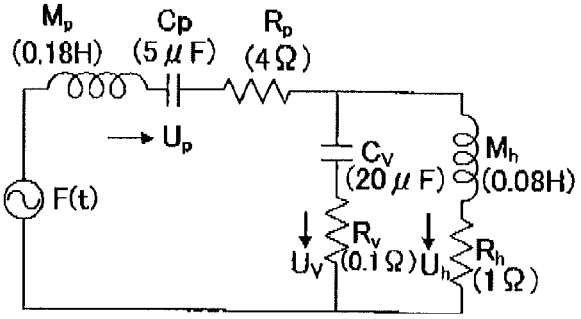
FIG. 2B is a view illustrating an equivalent electric circuit that represents the two-mass model.
Figure 3A:
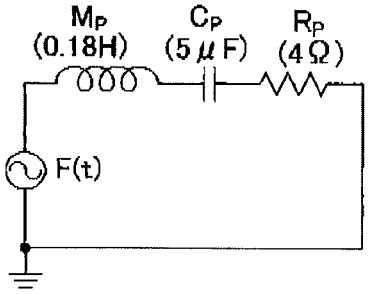
FIG. 3A is a view illustrating an equivalent electric circuit that represents only elements relating to a top board by excluding elements relating to air from the equivalent electric circuit illustrated in FIG. 2B.
Figure 4A:
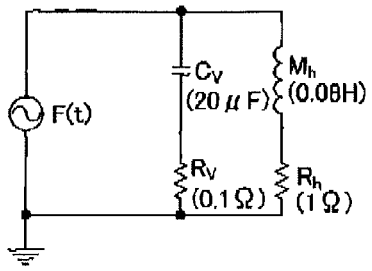
Figure 4B:
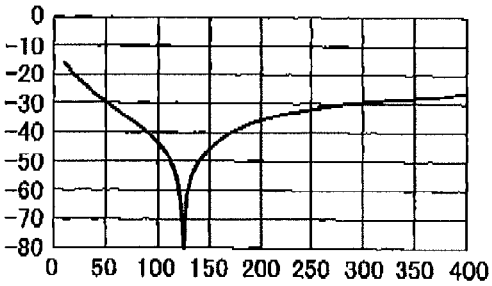
Figure 4C:
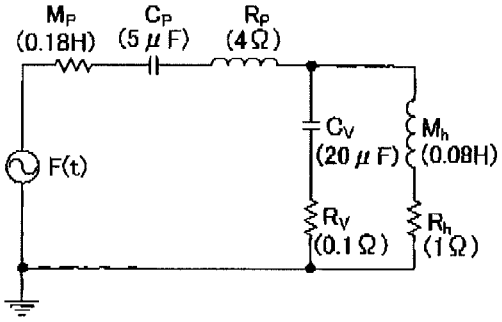
Figure 4D:
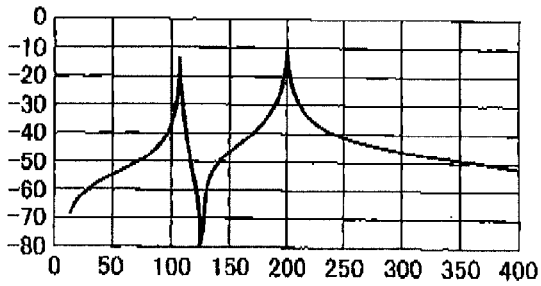
Figure 5:
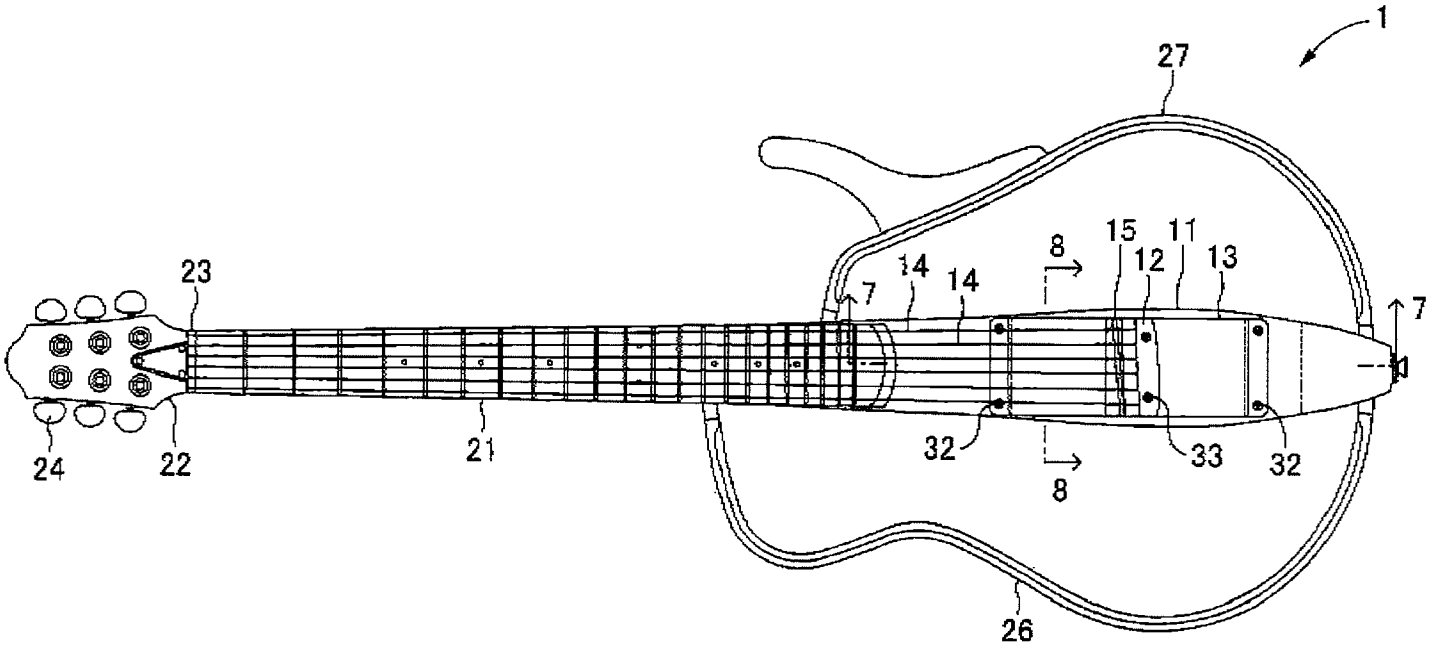
Figure 6:
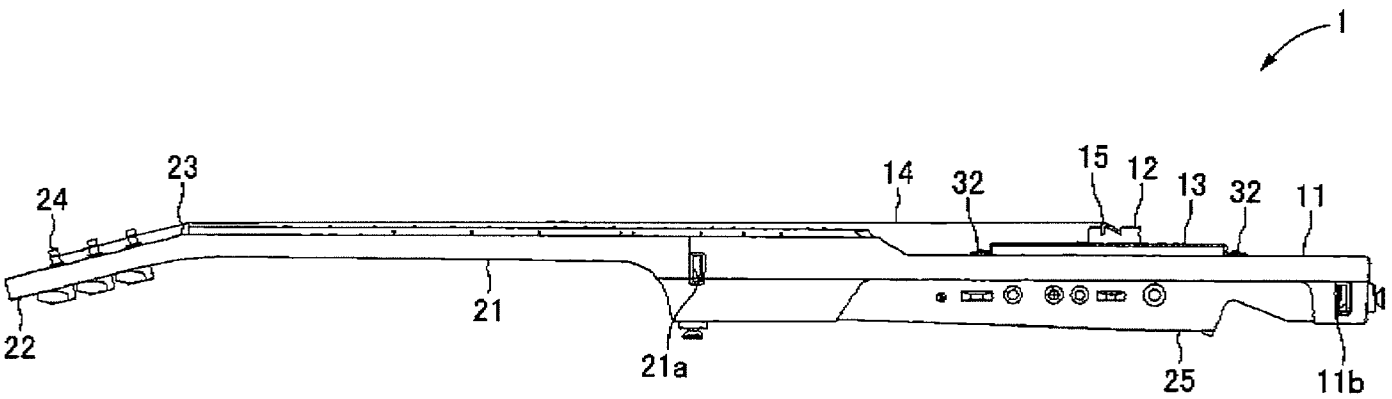
Figure 7:
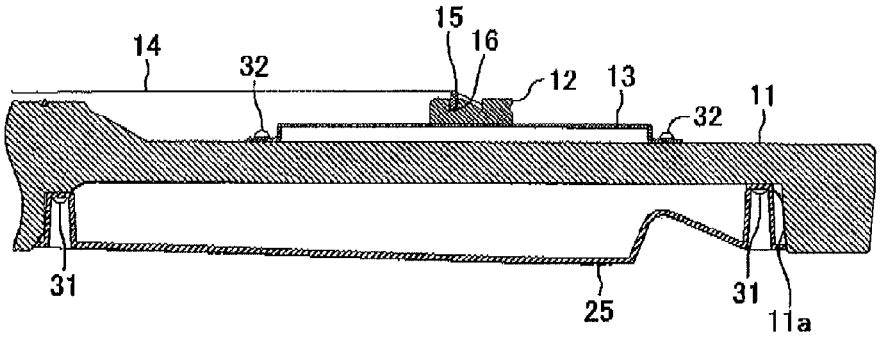
Figure 8:
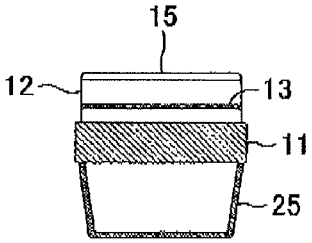
Figure 9:
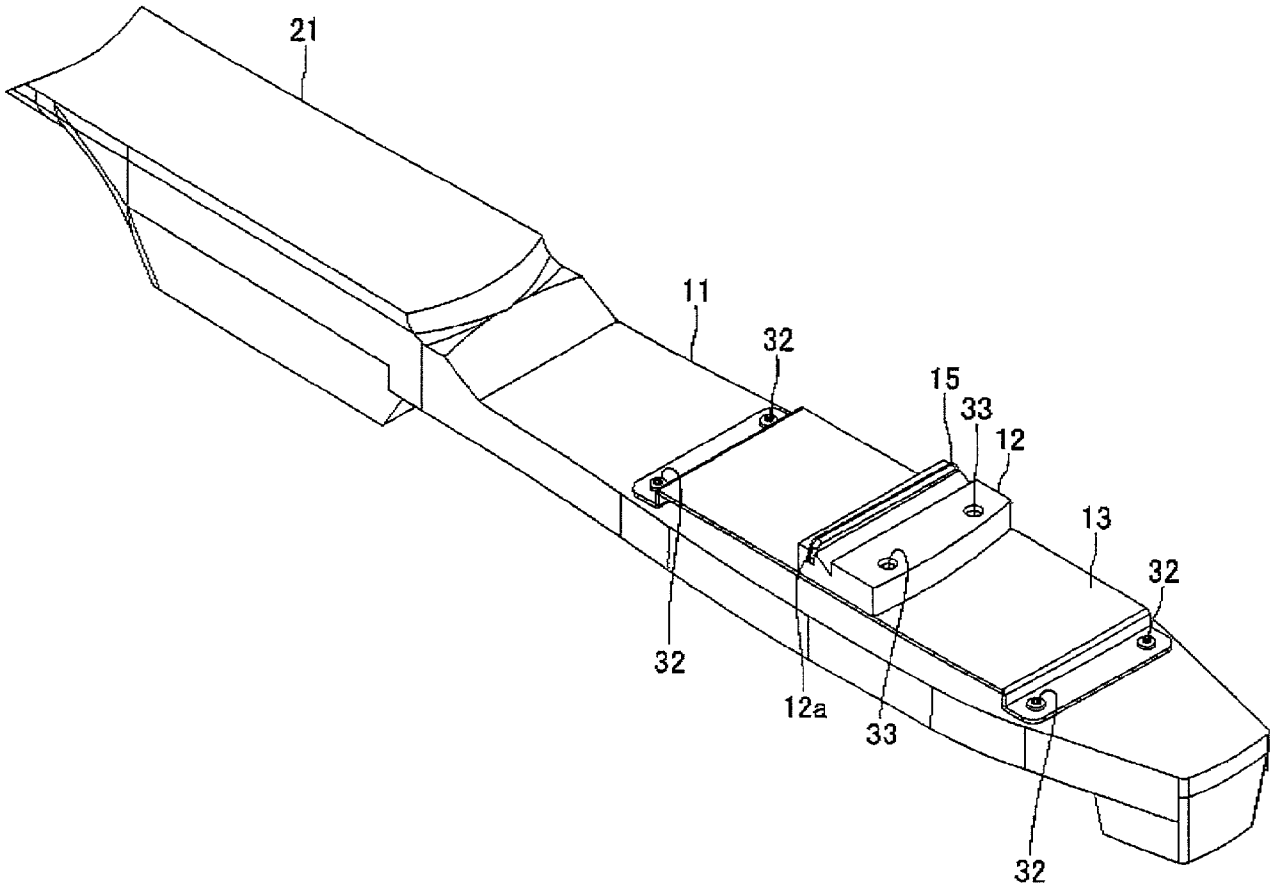
Figure 10:
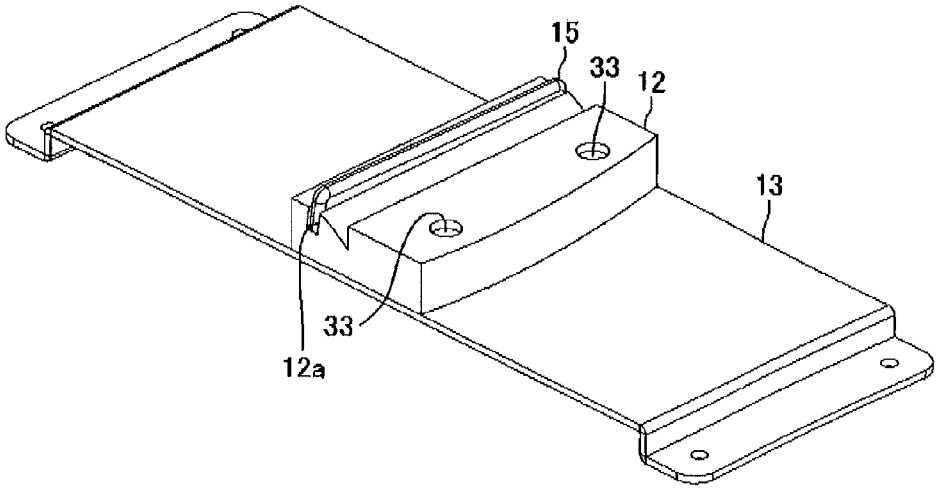
Figure 11:
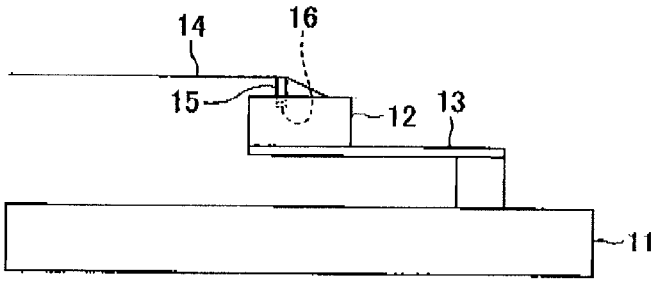
Figure 12:
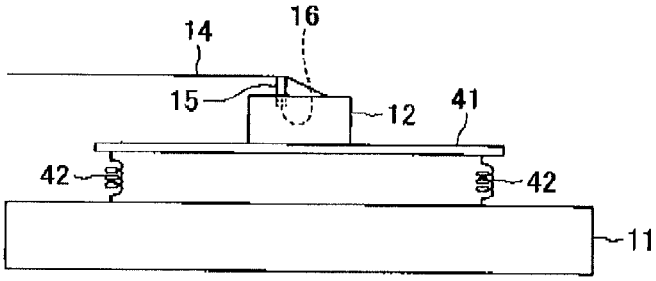
Figure 13:
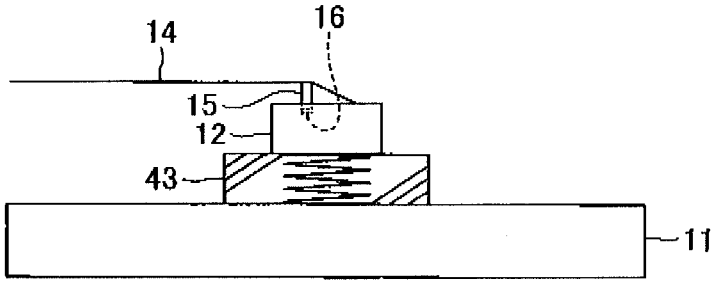
Figure 14A:
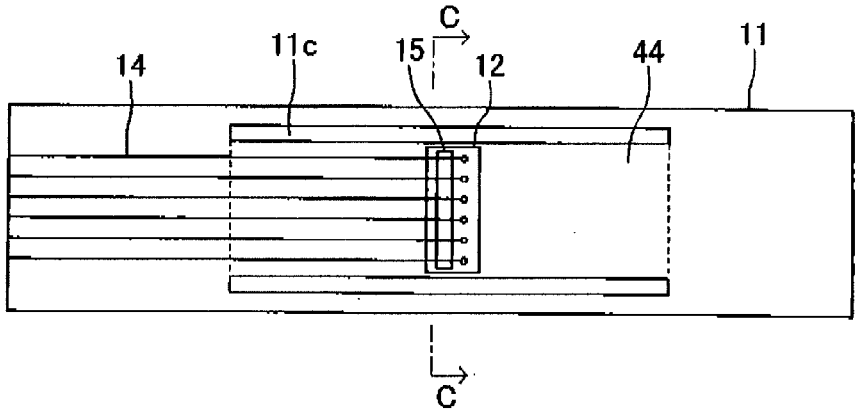
Figure 14B:
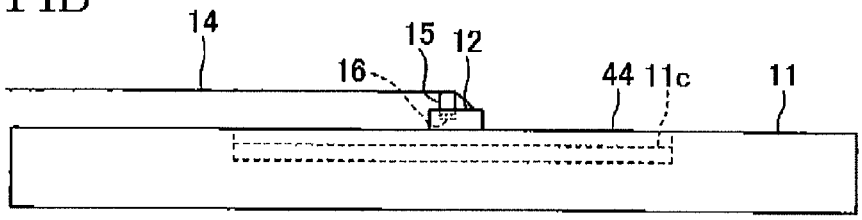
Figure 14C:
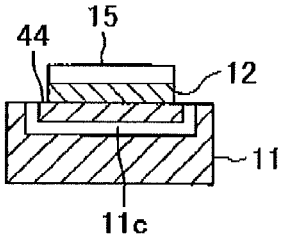
Figure 15A:
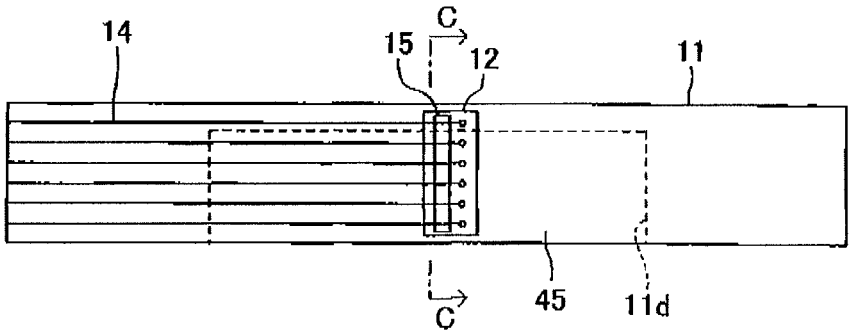
Figure 15B:
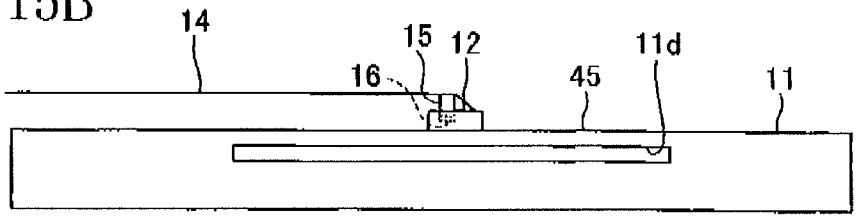
Figure 15C:
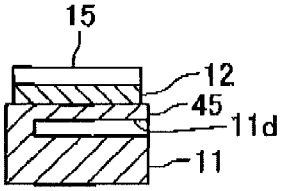

FIG. 4A is a view illustrating an equivalent electric circuit that represents only the elements relating to air by excluding the elements relating to the top board from the equivalent electric circuit illustrated in FIG. 2B, FIG. 4B is a graph illustrating a frequency response of the equivalent electric circuit illustrated in FIG. 4A, FIG. 4C is a view illustrating an equivalent electric circuit obtained by combining the equivalent electric circuit in FIG. 3A, and the equivalent electric circuit in FIG. 4A, and FIG. 4D is a graph illustrating a frequency response of the equivalent electric circuit illustrated in FIG. 4C;

FIG. 5 is a top view of an electric guitar according to one embodiment of the present invention;

FIG. 6 is a side view of the electric guitar in a state in which a body frame is removed from the electric guitar illustrated in FIG. 5 (in other words, FIG. 6 is a side view of the electric guitar when seen from the lower side in FIG. 5);

FIG. 7 is a partly enlarged cross-sectional view of the electric guitar taken along line 7-7 in FIG. 5;

FIG. 8 is a partly enlarged cross-sectional view of the electric guitar taken along line 8-8 in FIG. 5;

FIG. 9 is an enlarged perspective view of a body of the electric guitar illustrated in FIGS. 5 and 6;

FIG. 10 is an enlarged perspective view illustrating a bridge supporter illustrated in FIGS. 5 and 6 in a state in which the bridge supporter is separated from the body;

FIG. 11 is a schematic side view illustrating a strings-support portion of an electric stringed musical instrument according to a modification;

FIG. 12 is a schematic side view illustrating a strings-support portion of an electric stringed musical instrument according to another modification;

FIG. 13 is a schematic side view illustrating a strings-support portion of an electric stringed musical instrument according to another modification;

FIG. 14A is a schematic top view illustrating a strings-support portion of an electric stringed musical instrument according to another modification, FIG. 14B is a schematic side view of FIG. 14A, and FIG. 14C is a schematic cross-sectional view taken along line C-C in FIG. 14A;

FIG. 15A is a schematic top view illustrating a strings-support portion of an electric stringed musical instrument as a modification of the electric stringed musical instrument illustrated in FIG. 14, FIG. 15B is a schematic side view of FIG. 15A, and FIG. 15C is a schematic cross-sectional view taken, along line C-C in FIG. 15A;

DETAILED DESCRIPTION OF THE EMBODIMENT a. Example of Basic Structure

First, there will be explained, by way of example, an electric stringed musical instrument having a basic structure of the present invention with reference to FIG. 1.

The electric stringed musical instrument includes a body 11 made of wood and having high stiffness. Mounted on the body 11 is a bridge supporter 13 for supporting a bridge 12 by means of its spring structure. The bridge supporter 13 is an elastic metal plate, specifically, a plate spring elongated in a direction in which strings 14 extend. Opposite end portions of the bridge supporter 13 are bent generally perpendicularly so as to extend in the same direction (the down direction in FIG. 1). The bridge supporter 13 is fixed at its opposite ends to the body 11. The bridge 12 is an elongated member extending in a direction perpendicular to the direction in which the strings 14 extend. The bridge 12 is formed of a material such as wood and resin and fixed to the bridge supporter 13. Fixed on the bridge 12 is a saddle 15 which is made of a material such as resin and ivory. An upper end portion of the saddle 15 supports the strings 14 which are fastened at one ends to the bridge 12.

A pickup sensor 16 is mounted between the saddle 15 and the bridge 12. The pickup sensor 16 is designed to pick up or detect vibrations from the strings 14 to output an electric signal based on the vibrations. The pickup sensor 16 is constituted by a piezoelectric sensor, for example.

In the electric stringed musical instrument having the above-described structure, the mass of components around the bridge 12 is adjusted generally to the mass of components around a bridge of an acoustic stringed musical instrument (as one example of one acoustic stringed musical instrument) having a tone color which the electric stringed musical instrument attempts to mimic or produce, that is, the mass of components around the bridge 12 is adjusted generally to the mass of the bridge and components around a portion of the top board on which the bridge is mounted, but is not equal or identical to the mass of the bridge and the components around the portion of the top board on which the bridge is mounted. The reason for this structure will be described below. Also, spring characteristics (i.e., a spring constant) of the bridge supporter 13 are adjusted generally to spring characteristics of the portion of the top board around the bridge of the acoustic stringed musical instrument having a tone color which the electric stringed musical instrument attempts to mimic, but the spring characteristics of the bridge supporter 13 are not the same as those of the portion of the top board around the bridge of the acoustic stringed musical instrument. A loss due to the bridge 12 and a loss due to the bridge supporter 13 are respectively given appropriate constants and thereby adjusted generally to a loss due to a structure of components around the bridge of the acoustic stringed musical instrument having a tone color which the electric stringed musical instrument attempts to mimic, but the losses due to the bridge 12 and the bridge supporter 13 are not equal or identical to the loss due to the structure of the components around the bridge of the acoustic stringed musical instrument. It is noted that each of the losses and a loss described in the following explanation means an amount of energy that is lost from a vibrating system by its conversion to thermal energy due to friction caused by movement of a material such as components and particles of air and/or by its conversion to sound energy due to acoustic radiation.

Further, vibration characteristics of the bridge is affected by a vibration of air in the body in the acoustic stringed musical instrument, but in the electric stringed musical instrument having this example of the basic structure, vibration characteristics, of the bridge are not affected by a vibration of air in the body. Accordingly, the mass of the bridge and the components around the portion of the top board on which the bridge is mounted, the spring characteristics of the bridge supporter 13, and the losses due to the bridge 12 and the bridge supporter 13 are adjusted so as to slightly differ respectively from the mass of components around the top board, spring characteristics of a portion of the top board around the bridge; and the loss due to the structure of the components around the bridge in the acoustic stringed musical instrument, in order to take into account effects of the vibration of the air in the body of the acoustic stringed musical instrument.

As a result, in the electric stringed musical instrument having the above-described structure, vibration characteristics of the electric stringed musical instrument vibrated by the strings 14 being vibrated are made generally equal to those of the acoustic stringed musical instrument having a tone color which the electric stringed musical instrument attempts to mimic. Also, propagation of energy between the bridge 12 and the strings 14 being vibrated by a musical performance is made generally equal to that of the acoustic stringed musical instrument having a tone color which the electric stringed musical instrument attempts to mimic. As a result, a sound volume, a tone quality, and decay characteristics of the electric stringed musical instrument with respect to a pitch are made generally equal to those of the acoustic stringed musical instrument having a tone color which the electric stringed musical instrument attempts to mimic. These characteristics appear in an instrument sound based on the electric signal obtained by conversion of the pickup sensor 16, allowing the stringed instrument having no resonance body to obtain an expressive power and a playability of an instrument having the resonance body. It is noted that these characteristics appear in a sound that can be heard directly through air though its volume is small because of the stringed instrument having no resonance body.

Here, there will be explained, using a mass model and equivalent electric circuits, a method of designing settings for the mass of the components around the bridge 12, the spring characteristics of the bridge supporter 13, and the losses due to the bridge 12 and the bridge supporter 13. FIG. 2A illustrates a two-mass model representing motion of a common acoustic guitar including a solid back board and a solid side face (i.e., an acoustic guitar having a resonance body). In FIG. 2A, F(t) represents the magnitude of a driving force acting on the top board, $m_p$ represents the mass of the top board, Kp represents the spring constant of the top board, $m_h$ represents the mass of air around the sound hole, and V represents the volume of the body.

FIG. 2B illustrates an equivalent electric circuit representative of the two-mass model in FIG. 2A. In FIG. 2B, F(t) represents an amplitude of voltage of an alternating-current power supply. Mp represents the inductance of a coil which corresponds to the mass $m_p$ of the top board, Cp represents the capacitance of a capacitor which corresponds to a spring compliance that is the inverse of the spring constant $k_p$ of the top board, and Rp represents the magnitude of resistance which corresponds to a loss due to the top board. The inductance Mp, the capacitance Cp, and the magnitude of resistance Rp are elements relating to the top board and are, for example, 0.18 H, 5 μF, and 4Ω, respectively. Mb represents the inductance of a coil which corresponds to the mass $m_h$ of air around the sound hole, Rh represents the magnitude of resistance which corresponds to a loss due to the air around the sound hole, Cv represents the capacitance of a capacitor which corresponds to a spring compliance that is the inverse of the spring constant of air in the body, and Rv represents the magnitude of resistance which corresponds to a loss due to the air in the body. The inductance Mh, the magnitude of resistance Rh, the capacitance Cv, and the magnitude of resistance Rv are elements relating to air and are, for example, 0.08 H, 1Ω, 20 μF, and 0.1Ω, respectively. Each of Up, Uh, and Uv represents a current corresponding to a velocity.

Figure 3B:
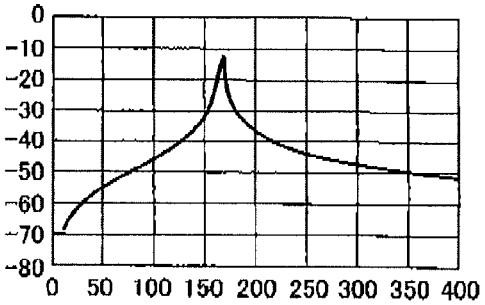
FIG. 3B is a graph illustrating a frequency response of the equivalent electric circuit illustrated in FIG. 3A.

FIG. 3A illustrates an equivalent electric circuit that represents only the elements Mp, Cp, and Rp relating to the top board by excluding the elements Mh, Rh, Cv, and Rv relating to air, FIG. 3B illustrates a frequency response of this equivalent electric circuit. FIG. 3B indicates that the top board causes a large peak of resonance which appears around 170 Hz in the electric stringed musical instrument having no resonance body. On the other hand, FIG. 4A illustrates an equivalent electric circuit that represents only the elements Mh, Rh, Cv, and Rv relating to air by excluding the elements Mp, Cp, and Rp relating to the top board. FIG. 4B illustrates a frequency response of this equivalent electric circuit. FIG. 4B indicates that, in the acoustic guitar having a resonance body, the air around the sound hole and in the body causes a large anti-resonance (i.e., the Helmholtz resonance) whose dip appears around 125 Hz in the vibration characteristics of the acoustic guitar having a resonance body. Combining the equivalent electric circuits in FIG. 3A and FIG. 4A forms an equivalent electric circuit illustrated in FIG. 4C (which is identical to that in FIG. 2B). FIG. 4D illustrates a frequency response of this equivalent electric circuit. FIG. 4D indicates that the vibration frequency response of the acoustic guitar having a resonance body has: two peaks of resonance which appear around 110 Hz and around 200 Hz; and a dip of anti-resonance which appears around 125 Hz.

On the other hand, vibration characteristics of the stringed musical instrument having no resonance body are principally determined by a resonance of the bridge supporter 13, and only one peak appears in the vibration characteristics of the stringed musical instrument having no resonance body. Accordingly, the frequency of this one peak needs to be adjusted to that of one of the two peaks of the vibration characteristics of the acoustic guitar having a resonance body. In this case, the frequency of the one peak may be adjusted to a lower one of the frequencies of the two peaks, i.e., the peak around 110 Hz and the peak around 200 Hz, in the acoustic guitar having a resonance body, but it has been confirmed that, in a case where the frequency of the one peak is adjusted to a higher one of the frequencies of the two peaks, it is possible to obtain a sound more closer to the instrument sound of the acoustic guitar having a resonance body. Accordingly, the frequency of the one peak of the vibration characteristics of the stringed musical instrument having no resonance body is preferably adjusted to the higher one of the frequencies of the two peaks. This higher frequency preferably falls within a range between 90 Hz and 270 Hz in view of acoustic stringed musical instruments other than the acoustic guitar such as a violin, a cello, a mandolin, a ukulele, and a bass.

Since it is considered that a spring component of air in the body acts on vibrations of the top board of the acoustic guitar having a resonance body, and thereby the frequency of a peak due to the top board is made higher, the frequency of the one peak is preferably adjusted especially such that the spring characteristics of the bridge supporter 13 for supporting the bridge 12 so as to allow vibrations of the bridge 12 are made stiffer, that is, the spring constant of the bridge supporter 13 is preferably adjusted so as to be larger than the spring constant $k_p$ of the top board of the acoustic guitar having a resonance body. The mass of components around the bridge 12 and the losses due to the bridge 12 and the bridge supporter 13 in the example of the basic structure are set taking this respect into consideration. That is, as described above, the following points are preferably considered in designing the electric stringed musical instrument. The frequencies of the two peaks of the vibration characteristics of the acoustic stringed musical instrument having a resonance body and the frequency of the one peak of the vibration characteristics of the electric stringed musical instrument having no resonance body are obtained. The mass of components around the bridge 12, the losses due to the bridge 12 and the bridge supporter 13, and the spring constant of the bridge supporter 13 are designed such that the frequency of the one peak is made closer to the frequency of the higher one of the frequencies of the two peaks. In other words, the mass of components around the bridge 12, the losses due to the bridge 12 and the bridge supporter 13, and the spring constant of the bridge supporter 13 are designed such that the frequency of the one peak is made closer to the frequency of the higher one of the frequencies of the two peaks, when compared with a case where the electric stringed musical instrument does not include the bridge supporter 13.

b. One Embodiment

Figure 1:
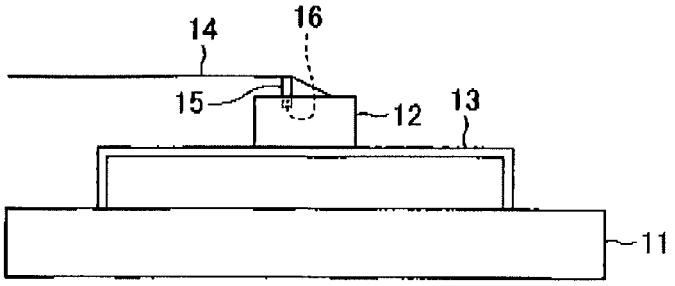
FIG. 1 is a schematic side view illustrating a string support portion of an electric stringed musical instrument having a basic structure of the present invention.

There will be next explained, with reference to FIGS. 5-8, one embodiment of the electric stringed musical instrument having the basic structure illustrated in FIG. 1, taking an electric guitar 1 as an example.

The electric guitar 1 includes the body 11 and a neck 21 and includes the plurality of strings 14 tensioned between: the bridge 12 and the bridge supporter 13 fixed on the top of the body 11; and a head 22 provided at an end portion of the neck 21. The body 11 is a thick wood member elongated so as to have generally a rectangular shape as seen from an upper side thereof. The body 11 also has such high stiffness that does not cause acoustic vibrations. The neck 21 is formed integrally with the body 11 so as to extend and has a fingerboard on an upper face thereof. The head 22 is formed integrally with the neck 21. The plurality of strings 14 are supported at their opposite end portions by the saddle 15 fixed to the bridge 12 and a nut 23 provided on the end portion of the neck 21, respectively, and opposite ends of the strings 14 are fastened to the bridge 12 and pegs 24, respectively.

A lower face of the body 11 has a recessed portion 11*a*, and a thin cover 25 is secured to the lower face of the body 11 by screws 31, so that a space is formed in the cover 25. Electric circuits, not shown, are provided in this space, and components provided on an outer face of the cover 25 include connection terminals for the electric circuits and elements for operating the electric circuits. Body frames 26, 27 are respectively provided on opposite sides of the body 11 and the neck 21. Each of the body frames 26, 27 is formed like a thin curved plate formed of a material such as metal, resin, and wood. Opposite ends of the body frames 26, 27 are respectively fitted in holes 11*b*, 21*a* formed in side faces of the body 11 and the neck 21, whereby the body frames 26, 27 are mounted on the body 11 and the neck 21, respectively.

There will be next explained the bridge supporter 13 in detail with reference to FIGS. 9 and 10. The bridge supporter 13 is constituted by a metal plate spring whose opposite end portions in its longitudinal direction are bent like a hook (so as to have an L shape), and the bridge supporter 13 is secured at is opposite end portions to an upper face of the body 11 by screws 32. The bridge 12 formed of wood or resin is fixed by screws 33 to an upper face of a central portion of the bridge supporter 13 in, its longitudinal direction. An upper face of the bridge 12 has a square slit 12*a* in which the saddle 15 formed of, e.g., resin or ivory is fitted and fixed. The pickup sensor 16 (see FIG. 7) constituted by a piezoelectric element is disposed between the bridge 12 and a bottom face of the slit 12*a*, i.e., the saddle 15. The pickup sensor 16 detects or picks up vibrations transmitted through the saddle 15 and the bridge 12, converts them to an electric signal, and output it to the electric circuits (i.e., an electric circuit device).

As in the example of the basic structure, the electric guitar 1 according to the one embodiment having the above-described structure can also mimic the vibration characteristics (i.e., the resonance characteristics) of the top board (the bridge) of the acoustic guitar having a resonance body by means of the bridge supporter 13. As a result, also in this electric guitar 1 according to the one embodiment, as described above, the sound volume, the time quality, and the decay characteristics with respect to a pitch are made generally equal to those of the acoustic guitar having a resonance body. Since these characteristics appear in an instrument sound based on the electric signal converted by the pickup sensor 16, the electric guitar having no resonance body can also obtain an expressive power and a playability of the acoustic guitar having a resonance body.

c. Modifications

While the example of the basic structure and the one embodiment have been described above, it is to be understood that the invention is not limited to the details of the example of the basic structure and the one embodiment, but may be embodied with various changes and modifications, which may occur to those skilled in the art, without departing from the spirit and scope of the invention.

While an example of application of the basic structure according to the present invention to the electric guitar 1 is explained in the above-described one embodiment, the basic structure is applicable to electric stringed musical instruments other than the electric guitar 1.

In the example of the basic structure and the one embodiment described above, the opposite end portions of the bridge supporter 13 for supporting the bridge 12 are fixed to the body 11. Instead of this structure, as illustrated in FIG. 11, only one end of the bridge supporter 13 may be fixed to the body 11, that is, the bridge supporter 13 may have a cantilever structure with respect to the body 11. This structure also allows vibrations of the bridge supporter 13, leading to the same effects as in the example of the basic structure and the one embodiment described above.

In the example of the basic structure and the one embodiment described above, the bridge supporter 13 for supporting the bridge 12 is constituted by a plate spring. Instead of this structure, as illustrated in FIG. 12, the bridge supporter may be constituted by a plate 41 having high stiffness and a plurality of coil springs 42 fixed to a lower face of the plate 41 for supporting the plate 41. That is, the electric stringed musical instrument may be configured such that lower ends of the plurality of coil springs 42 are fixed to the body 11, upper ends of the plurality of coil springs 42 are fixed to a lower face of the plate 41, and the bridge 12 is fixed to an upper face of the plate 41. This structure also allows the plate 41 to be vibrated by the coil springs 42, leading to the same effects as in the example of the basic structure and the one embodiment described above.

Instead of the bridge supporter 13 constituted by the plate spring in the example of the basic structure and the one embodiment described above, as illustrated in FIG. 13, a bridge supporter 43 as an elastic member formed of an elastic material such as rubber and resin may be sandwiched between the body 11 and the bridge 12. That is, the electric stringed musical instrument may be configured such that the bridge supporter 43 as the elastic member is fixed to the upper face of the body 11, and the bridge 12 is fixed to the bridge supporter 43. Also in this structure, the bridge 12 is supported by the body 11 via the bridge supporter 43 as the elastic member in a state in which the bridge 12 can vibrate, leading to the same effects as in the example of the basic structure and the one embodiment described above.

Instead of the bridge supporter 13 constituted by the plate spring in the example of the basic structure and the one embodiment described above, a structure illustrated in FIGS. 14A-14C may be employed for supporting the bridge 12. That is, a square slit (a space) 11*c* is formed in the wooden body 11 under the bridge 12 so as to extend in the direction in which the strings 14 extend, and opposite ends of the slit 11*c* in the direction perpendicular to the direction in which the strings 14 extend are open in the top of the body 11. The body 11 located on an upper side of the slit 11*c* is formed to have a thin thickness so as to allow vibrations of the body 11 in an up and down direction. In other words, this thin portion of the body 11 serves as a bridge supporter 44 that is an alternative to the bridge supporter 13 constituted by the plate spring in the example of the basic structure and the one embodiment described above, and the bridge 12 is supported by the spring structure of the bridge supporter 44 so as to be vibrated. Also in this structure, the bridge 12 is supported by the body 11 via the bridge supporter 44 as the elastic member in a state in which the bridge 12 can be vibrated, leading to the same effects as in the example of the basic structure and the one embodiment described above.

As a modification of the electric stringed musical instrument illustrated in FIG. 14, as illustrated in FIGS. 15A-15C, a slit 11*d* opening in a side face of the body 11 may be formed instead of the slit 11*c* in FIG. 14. That is, a square slit (a space) 11*d* is formed in the wooden body 11 under the bridge 12 so as to extend in the direction in which the strings 14 extend, and one of opposite ends of the slit 11*d* in the direction perpendicular to the direction in which the strings 14 extend is open in the side face of the body 11. Alternatively, both of the opposite ends of the slit 11*d* in the direction perpendicular to the direction in which the strings 14 extend may be open in side faces of the body 11. Also in this structure, the body 11 located on an upper side of the slit 11*d* is formed to have a thin thickness so as to allow vibrations of the body 11 in the up and down direction, and the portion of the body 11 serves as a bridge supporter 45 that is an alternative to the bridge supporter 13 constituted by the plate spring in the example of the basic structure and the one embodiment described above. This structure also allows the bridge 12 to be supported by the spring structure of the bridge supporter 45 in the state in which the bridge 12 can be vibrated, leading to the same effects as in the example of the basic structure and the one embodiment described above.

The pickup sensor 16 is provided on the lower face of the saddle 15 in the example of the basic structure, the one embodiment, and the above-described modifications described above, but the present invention is not limited to this structure. That is, the pickup sensor 16 may be provided at any position near the bridge 12 as long as the pickup sensor 16 can detect vibrations of the bridge 12 which are caused by vibrations of the strings 14. For example, the pickup sensor 16 may be provided on an outer circumferential surface of the bridge 12 or the bridge supporter 13. A plurality of pickup sensors may be provided at different positions to use outputs of the sensors in combination.

A piezoelectric element is used as the pickup sensor 16 in the example of the basic structure, the one embodiment, and the modifications described above. However, any sensor may be used as the pickup sensor 16 as long as the sensor can detect vibrations around the bridge 12 (e.g., a displacement, a velocity, and acceleration). Thus, any vibration sensor other than the piezoelectric element can be used as the pickup sensor. For example, sensors such as a semiconductor vibration sensor and a capacitive vibration sensor can be used.

In the example of the basic structure, the one embodiment, and the modifications described above, the sound volume, the tone quality, and the decay characteristics with respect to a pitch are made generally equal to those of the acoustic stringed musical instrument. Instead of this structure, the sound volume, the tone quality, and the decay characteristics with respect to a pitch may be partly made generally equal to those of the acoustic stringed musical instrument, and this structure can also obtain an expressive power and a playability of the acoustic stringed musical instrument having a resonance body.

Though not explained in the example of the basic structure and the one embodiment described above; circuits such as an equalizing circuit and a convolving circuit are preferably provided in the electric circuit device to process electric signals produced by the pickup sensor 16 as needed and output the processed signals. This configuration can adjust not only differences of sound volume and tone quality with respect to a pitch but also a speed of decay of an output signal relating to a speed of decay of the strings 14.

In the example of the basic structure and the one embodiment described above, the spring constant of the bridge supporter of the electric stringed musical instrument having no resonance body is adjusted to be larger than that of the top board of the acoustic stringed musical instrument having a resonance body, but the present invention is not limited to this configuration. For example, the spring constant of the bridge supporter of the electric stringed musical instrument having no resonance body may be adjusted so as to be smaller than that of the top board of the acoustic stringed musical instrument having a resonance body to design the mass of components around the bridge and the losses due to the bridge and the bridge supporter.

What is claimed is:

1. An electric stringed musical instrument designed to mimic a vibration characteristic of a desired acoustic stringed musical instrument, the electron stringed musical instrument comprising:

a bridge;

a body for supporting a string via the bridge, the body having no soundbox;

a pickup detecting a vibration which has propagated from the string and outputting an electric signal as a function thereof; and a support having a spring structure which supports the bridge with respect to the body to bring a vibration characteristic of the electric stringed musical instrument closer to a vibration characteristic of the desired acoustic stringed musical instrument;

wherein:

the vibration characteristic of the electrical stringed musical instrument has a single peak;

the vibration characteristic of the desired acoustic musical instrument has first and second peaks, the frequency of the second peak being higher than the frequency of the first peak, the two peaks appearing due to (i) a top board of a sound box of the desired acoustic stringed musical instrument and (ii) air around a sound hole of the desired acoustic stringed musical instrument and in the sound box of the desired acoustic stringed musical instrument; and the support is configured to function such that the frequency of the single peak of the vibration characteristic of the electrical stringed musical instrument is brought closer to the frequency of the second peak of the desired acoustic stringed musical instrument when compared with the case where the supporter is not used.

2. The electric stringed musical instrument according to claim 1, wherein the supporter is formed of a plate.

3. The electric stringed musical instrument according to claim 1, wherein the supporter is constituted by an elastic member interposed between the body and the bridge.

4. The electric stringed musical instrument according to claim 1, wherein the supporter is constituted by a thin plate that is formed integrally with the body in a state in which a space is formed between the supporter and the body.

5. The electric stringed musical instrument according to claim 1, wherein a spring constant of the supporter is different from that of the top board of the sound box of the desired acoustic stringed musical instrument.

6. The electric stringed musical instrument according to claim 5, wherein the spring constant of the supporter is greater than that of the sound box of the desired acoustic stringed musical instrument.

7. A method of designing an electric stringed musical instrument to mimic a vibration characteristic of a desired acoustic stringed musical instrument, the vibration characteristic of the desired acoustic stringed musical instrument having first and second peaks, the frequency of the second peak being higher then the frequency of the first peak, the electric stringed musical instrument comprising a bridge, a body for supporting a string via the bridge, a pickup sensor for detecting a vibration which has propagated from the string and outputting an electric signal as a function thereof and a supporter having a spring structure which supports the bridge with respect to the body, the vibration characteristic of the electric stringed musical instrument having a single peak, the method comprising:

selecting a mass of components around the bridge of the electric stringed musical instrument, losses due to the bridge and the supporter, and a spring constant of the supporter such that the frequency of the single peak of the electric stringed musical instrument is brought closer to the frequency of the second peak of the vibration characteristic of the desired acoustic stringed musical instrument when compared with a case where the supporter is not used.

8. The method of designing the electric stringed musical instrument according to claim 7, wherein the frequency of the single peak in the vibration characteristic of the electric stringed musical instrument appears due to the supporter, and the frequencies of the two peaks in the vibration characteristic of the desired acoustic stringed musical instrument appear due to (i) a top board of a sound box of the desired acoustic stringed musical instrument and (ii) air around a sound hole of the desired acoustic stringed musical instrument and in the sound box of the desired acoustic stringed musical instrument.

9. The method of designing the electric stringed musical instrument according to claim 7, further comprising:

obtaining the two frequencies of the two peaks in the vibration characteristic of the one acoustic stringed musical instrument;

obtaining the frequency of the single peak in the vibration characteristic of the electric stringed musical instrument; and selecting the mass of the components around the bridge of the electric stringed musical instrument, the losses due to the bridge and the supporter, and the spring constant of the supporter by referring to the obtained frequency of the single peak and the obtained frequencies of the two peaks.

10. The method of designing the electric stringed musical instrument according to claim 7, wherein the spring constant of the supporter is selected to be greater than the spring constant of a portion of a top board of the sound box of the one acoustic stringed musical instrument, which portion is located around a bridge of the desired acoustic stringed musical instrument.

11. The method of designing the electric stringed musical instrument according to claim 7, further comprising:

obtaining the frequencies of the two peaks in the vibration characteristic of the one acoustic stringed musical instrument, using a first equivalent electric circuit converted from a mass model comprising a top board of a sound box of the desired acoustic stringed musical instrument and elements relating to air;

obtaining the frequency of the single peak in the vibration characteristic of the electric stringed musical instrument, using a second equivalent electric circuit produced by excluding the elements relating to air from the first equivalent electric circuit; and selecting the mass of the components around the bridge of the electric stringed musical instrument, the losses due to the bridge and the supporter, and the spring constant of the supporter such that the frequency of the single peak in the vibration characteristic of the electric stringed musical instrument is brought closer to the frequency of the second peak of the vibration characteristic of the desired acoustic stringed musical instrument when compared with the case where the supporter is not used.

12. An electric stringed musical instrument comprising:

a bridge;

a body for supporting a string via the bridge, the body having no sound box;

a pickup sensor for detecting a vibration which has propagated from the string and outputting an electric signal as a function thereof; and a supporter having a spring structure which supports the bridge with respect to the body to bring a vibration characteristic of the electric stringed musical instrument closer to a vibration characteristic of a desired acoustic stringed musical instrument, wherein:

the vibration characteristic of the electrical stringed musical instrument has a single peak;

the vibration characteristic of the desired acoustic musical instrument has first and second peaks the second peak having a higher frequency than the first peak, the two peaks appearing due to (i) a top board of a sound box of the desired acoustic stringed musical instrument and (ii) air around a sound hole of the desired acoustic stringed musical instrument and in the sound box of the desired acoustic stringed musical instrument, a mass of components around the bridge of the electrical stringed musical instrument, losses due to the bridge and the supporter, and a spring constant of the supporter are selected such that the frequency of the single peak in the vibration characteristic of the electric stringed musical instrument is brought closer to the frequency of the second peak in the vibration characteristic of the desired acoustic stringed musical instrument when compared with a case where the supporter is not used.

* * * * *